US009134660B2

(12) United States Patent
Koda et al.

(10) Patent No.: US 9,134,660 B2
(45) Date of Patent: Sep. 15, 2015

(54) FIXING DEVICE AND IMAGE FORMING APPARATUS

(71) Applicant: KYOCERA Document Solutions Inc., Osaka-shi, Osaka (JP)

(72) Inventors: Shoji Koda, Osaka (JP); Ryo Matsuyama, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/163,121

(22) Filed: Jan. 24, 2014

(65) Prior Publication Data

US 2014/0212159 A1 Jul. 31, 2014

(30) Foreign Application Priority Data

Jan. 28, 2013 (JP) ..... 2013-013107

(51) Int. Cl.
*G03G 15/20* (2006.01)

(52) U.S. Cl.
CPC ..... *G03G 15/2039* (2013.01); *G03G 15/2082* (2013.01); *G03G 2215/2035* (2013.01)

(58) Field of Classification Search
CPC ..... G03G 15/2039; G03G 15/2046; G03G 15/2082
USPC ..... 399/334
See application file for complete search history.

(56) References Cited

U.S. PATENT DOCUMENTS

| | | | | |
|---|---|---|---|---|
| 6,072,964 | A * | 6/2000 | Abe et al. | 399/69 |
| 7,238,924 | B2 * | 7/2007 | Kondo et al. | 219/619 |
| 2010/0296828 | A1 * | 11/2010 | Hara et al. | 399/69 |
| 2011/0274446 | A1 * | 11/2011 | Fukushi | 399/22 |
| 2012/0201558 | A1 * | 8/2012 | Watanabe | 399/69 |

FOREIGN PATENT DOCUMENTS

| | | | |
|---|---|---|---|
| JP | 2004233507 | A | 8/2004 |
| JP | 2005221719 | A | 8/2005 |
| JP | 2010271454 | A | 12/2010 |
| JP | 2012113266 | A | 6/2012 |
| JP | 2012177899 | A | 9/2012 |

* cited by examiner

*Primary Examiner* — Clayton E Laballe
*Assistant Examiner* — Leon W Rhodes, Jr.
(74) *Attorney, Agent, or Firm* — Alleman Hall McCoy Russell & Tuttle LLP

(57) ABSTRACT

A fixing device includes a fixing belt, a pressurizing member, a heat source, and a temperature sensing device. The fixing belt is rotatably provided. The pressurizing member is rotatably provided and is in pressed contact with the fixing belt to form a fixing nip between the pressurizing member and the fixing belt. The heat source heats the fixing belt. The temperature sensing device detects the temperature of the fixing belt. The temperature sensing device has a sensing element that is in contact with an inner circumferential surface of the fixing belt in a neighboring region of an end portion of the fixing nip and a pressing member configured to press the sensing element against the inner circumferential surface of the fixing belt.

10 Claims, 8 Drawing Sheets

FIXING DEVICE AND IMAGE FORMING APPARATUS

INCORPORATION BY REFERENCE

This application is based upon and claims the benefit of priority from the corresponding Japanese Patent Application No. 2013-013107 filed on Jan. 28, 2013, the entire contents of which are incorporated herein by reference.

BACKGROUND

The present disclosure relates to a fixing device that fixes a toner image onto a paper sheet and an image forming apparatus including the fixing device.

Electrophotographic image forming apparatuses such as copying machines and printers are conventionally provided with a fixing device that fixes a toner image onto a paper sheet. As a fixing method used in such a fixing device, a "heat roller method" may be used in which a toner image is fixed onto a paper sheet at a fixing nip formed between a pair of rollers. The heat roller method is superior in terms of the thermal efficiency or the safety. Meanwhile, due to a demand for reduction of the warm-up period and energy saving, a "belt method" is also known in which a fixing nip is formed using a fixing belt to be heated by a heat source.

The belt method includes a method in which a fixing belt is caused to slide on a pushing member in contact with the inner circumferential surface of the fixing belt (hereinafter, referred to as "slide belt method"). According to such a slide belt method, it is possible to reduce the heat capacity of members in contact with the fixing belt and perform more focused heating on the fixing belt compared to the case where a fixing belt is provided around a roller.

However, employment of the above-described slide belt method involves a problem in that stress is concentrated on the fixing belt in a neighboring region of an end portion of the fixing nip, and therefore the fixing belt is locally deformed. In particular, the fixing belt may be broken earlier when the fixing belt is formed of a relatively hard material (for example, a metal) and the stress concentration is intense. The early breaking of the fixing belt makes the fixing device unusable and therefore shortens the life of the fixing device. For this problem, a configuration is known in which the cross-sectional shape of a central portion of the pushing member in contact with the inner circumferential surface of the fixing belt is made different from the cross-sectional shapes of opposite end portions thereof to avoid the deformation of the fixing belt.

Incidentally, a fixing device fixes toner images onto paper sheets in a variety of sizes ranging from small to large. The case where the fixing device fixes a toner image onto a paper sheet in a first size (for example, B5 paper sheet) will be discussed. In this case, heat is consumed by heating of the paper sheet in the first size in a region of the fixing belt through which the paper sheet in the first size passes (hereinafter referred to as "first size sheet passage region"). On the other hand, no heat is consumed in regions which are outside the first size sheet passage region and through which a paper sheet in a second size (for example, A4 paper sheet) having a larger width than the paper sheet in the first size passes (hereinafter, referred to as "non-first size sheet passage regions"). Thus, the temperature of the non-first size sheet passage regions will be higher than the temperature of the first size sheet passage region, and the distribution of the temperature of the roller and the belt forming the fixing nip will be non-uniform. For this problem, a configuration is known in which the temperature of the non-first size sheet passage regions is prevented from rising to be excessively higher than the temperature of the first size sheet passage region with a thermally conductive member.

SUMMARY

A fixing device according to an aspect of the present disclosure includes a fixing belt, a pressurizing member, a heat source, and a temperature sensing device. The fixing belt is rotatably provided. The pressurizing member is rotatably provided and is in pressed contact with the fixing belt to form a fixing nip between the pressurizing member and the fixing belt. The heat source heats the fixing belt. The temperature sensing device detects the temperature of the fixing belt. The temperature sensing device has a sensing element that is in contact with an inner circumferential surface of the fixing belt in a neighboring region of an end portion of the fixing nip and a pressing member configured to press the sensing element against the inner circumferential surface of the fixing belt.

An image forming apparatus according to another aspect of the present disclosure includes a fixing device. The fixing device includes a fixing belt, a pressurizing member, a heat source, and a temperature sensing device. The fixing belt is rotatably provided. The pressurizing member is rotatably provided and is in pressed contact with the fixing belt to form a fixing nip between the pressurizing member and the fixing belt. The heat source heats the fixing belt. The temperature sensing device detects the temperature of the fixing belt. The temperature sensing device has a sensing element that is in contact with an inner circumferential surface of the fixing belt in a neighboring region of an end portion of the fixing nip and a pressing member configured to press the sensing element against the inner circumferential surface of the fixing belt.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
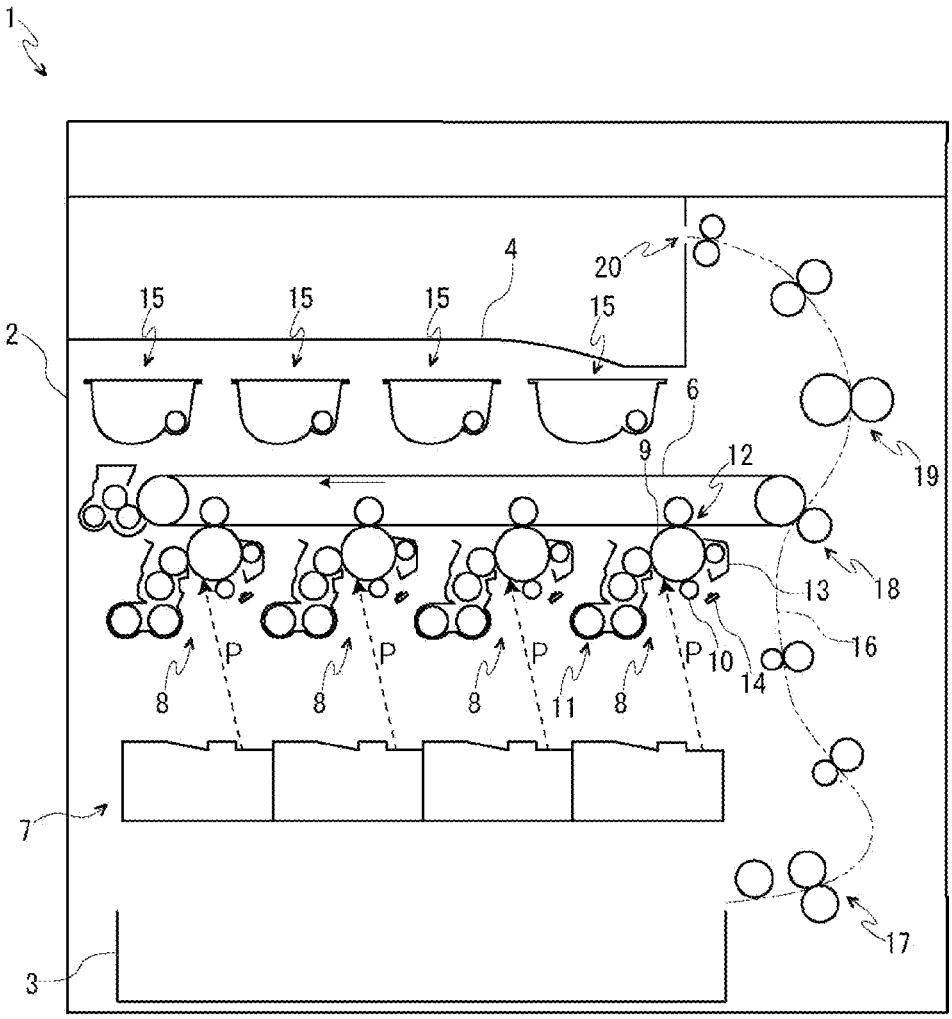
FIG. 1 is a schematic view showing a schematic configuration of a color printer according to an embodiment of the present disclosure.

First, a general configuration of a color printer 1 as an image forming apparatus will be described with reference to FIG. 1. FIG. 1 is a schematic view showing a schematic configuration of the color printer according to an embodiment of the present disclosure.

The color printer 1 has a printer main body 2 having a box-like shape. A lower part of the printer main body 2 is provided with a sheet feed cassette 3 containing paper sheets (not shown). An upper part of the printer main body 2 is provided with a sheet discharge tray 4.

In a central part of the printer main body 2, an intermediate transfer belt 6 is provided so as to hang across a plurality of rollers. Under the intermediate transfer belt 6, exposure devices 7 each formed of a laser scanning unit (LSU) are disposed. In the vicinity of the intermediate transfer belt 6, four image forming portions 8 are provided for each toner color (for example, four colors of magenta, cyan, yellow, and black) along a lower part of the intermediate transfer belt 6. Each image forming portion 8 is provided with a rotatable photosensitive drum 9. Around each photosensitive drum 9, a charging device 10, a developing device 11, a primary transfer portion 12, a cleaning device 13, and a discharging device 14 are arranged in order of the primary transfer process. Above the developing devices 11, toner containers 15 corresponding to the respective image forming portions 8 are provided for each toner color.

A sheet conveyance path 16 is provided on one side in the printer main body 2 (right side on the page of the drawing). A sheet feed portion 17 is provided at an upstream end of the conveyance path 16. A secondary transfer portion 18 is provided in a middle region of the conveyance path 16 and at one end of the intermediate transfer belt 6 (right end on the page of the drawing). A fixing device 19 is provided in a downstream region of the conveyance path 16. A sheet exit 20 is provided at a downstream end of the conveyance path 16.

Next, an image formation operation by the color printer 1 having such a configuration will be described. When power has been applied to the color printer 1, various parameters are initialized and an initialization procedure including temperature setting for the fixing device 19 is performed. Then, when an image data has been input from a computer or the like connected to the color printer 1 and a direction of initiation of printing has been made, an image formation operation is performed as follows.

First, a surface of the photosensitive drum 9 is charged by the charging device 10, and subsequently an electrostatic latent image is formed on the surface of the photosensitive drum 9 with laser light (see an arrow P) from the exposure device 7. Next, the electrostatic latent image is developed as a toner image of a corresponding color by the developing device 11 with a toner supplied from the toner container 15. The toner image is primarily transferred onto a surface of the intermediate transfer belt 6 at the primary transfer portion 12. Each image forming portion 8 performs the above-described operation in sequence, thereby forming a full-color toner image on the intermediate transfer belt 6. A residual toner and a residual electric charge on the photosensitive drum 9 are removed by the cleaning device 13 and the discharging device 14.

Meanwhile, a paper sheet taken out of the sheet feed cassette 3 or a manual sheet feed tray (not shown) by the sheet feed portion 17 is conveyed to the secondary transfer portion 18 in timed relation with the above-described image formation operation. The full-color toner image on the intermediate transfer belt 6 is secondarily transferred onto the paper sheet at the secondary transfer portion 18. The paper sheet on which the toner image has been secondarily transferred is conveyed to the downstream side of the conveyance path 16 and enters the fixing device 19. The toner image is fixed onto the paper sheet in the fixing device 19. The paper sheet on which the toner image has been fixed is discharged from the sheet exit 20 onto the sheet discharge tray 4.

Next, the fixing device 19 will be described. An arrow Fr shown in FIGS. 3, 4, 6, and 7 represents a foreside (front side) of the fixing device 19.

Figure 2:
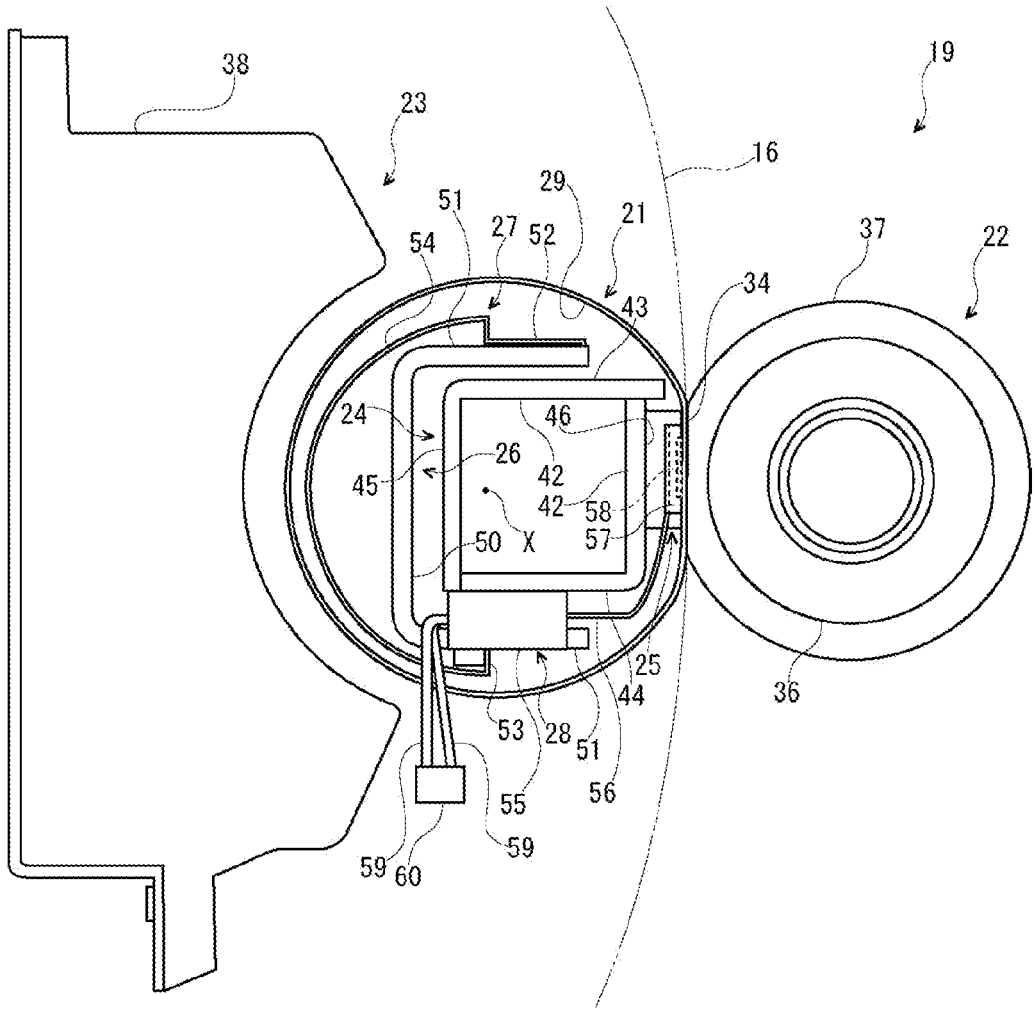
FIG. 2 is a front view showing a fixing device in the color printer according to an embodiment of the present disclosure shown in FIG. 1.

As shown in FIG. 2, the fixing device 19 includes a fixing belt 21, a pressurizing roller 22, an IH fixing unit 23, a supporting member 24, a pushing pad 25, a magnetic shielding plate 26, a guide plate 27, and a temperature sensing device 28. The pressurizing roller 22 is provided as a pressurizing member on the right side of the fixing belt 21. The IH fixing unit 23 is provided on the left side of the fixing belt 21. The supporting member 24 is provided in a substantial center of the inside of the fixing belt 21. The pushing pad 25 is provided as a pushing member on the right side of the supporting member 24 within the fixing belt 21. The magnetic shielding plate 26 is provided over the top and bottom sides, and the left side of the supporting member 24 within the fixing belt 21. The guide plate 27 is provided over the top and bottom sides, and the left side of the magnetic shielding plate 26 within the fixing belt 21. The temperature sensing device 28 is provided on a side of the front end of the fixing belt 21.

Figure 3:
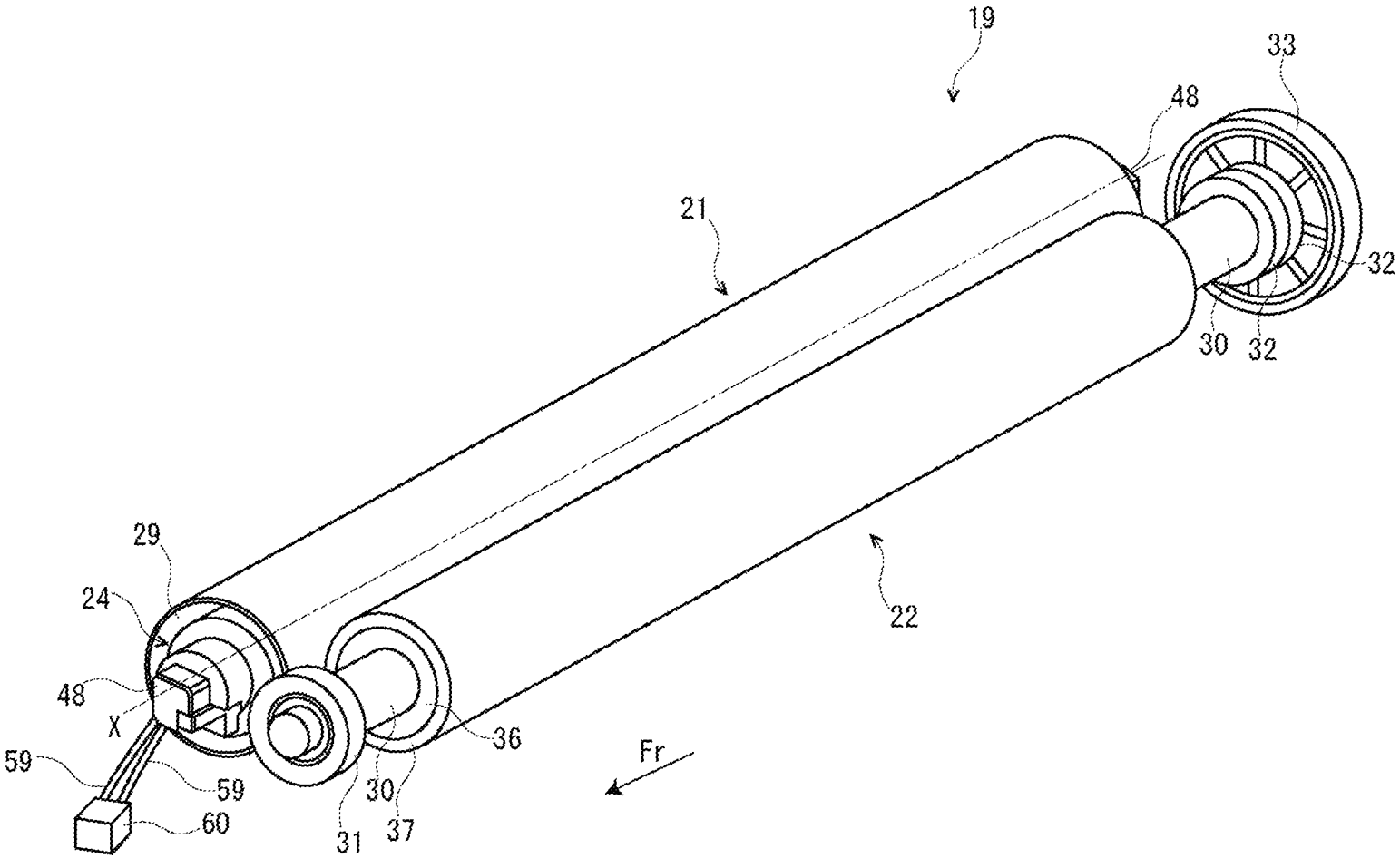
FIG. 3 is a perspective view showing the fixing device in the color printer according to an embodiment of the present disclosure shown in FIG. 1.

First, the fixing belt 21 will be described. As shown in FIG. 3, the fixing belt 21 is an endless belt having a substantially cylindrical shape elongated in a front-back direction. The fixing belt 21 is provided so as to be rotatable around a rotation axis X extending in the front-back direction. That is, in the present embodiment, the front-back direction is the rotation axis X direction.

The fixing belt 21 includes a backing layer, an elastic layer provided to surround the backing layer, and a release layer to coat the elastic layer, for example. The backing layer of the fixing belt 21 is formed by plating or rolling a metal such as nickel and copper, for example. The elastic layer of the fixing belt 21 is formed of silicone rubber, for example. The release layer of the fixing belt 21 is formed of fluorinated resin such as PFA, for example. In the drawings, the layers of the fixing belt 21 (the backing layer, the elastic layer, and the release layer) are shown without any distinction. Front and back end portions of the fixing belt 21 are each provided with a flange member (not shown) by which the outward move of the fixing belt 21 in the front-back direction is controlled.

Figure 4:
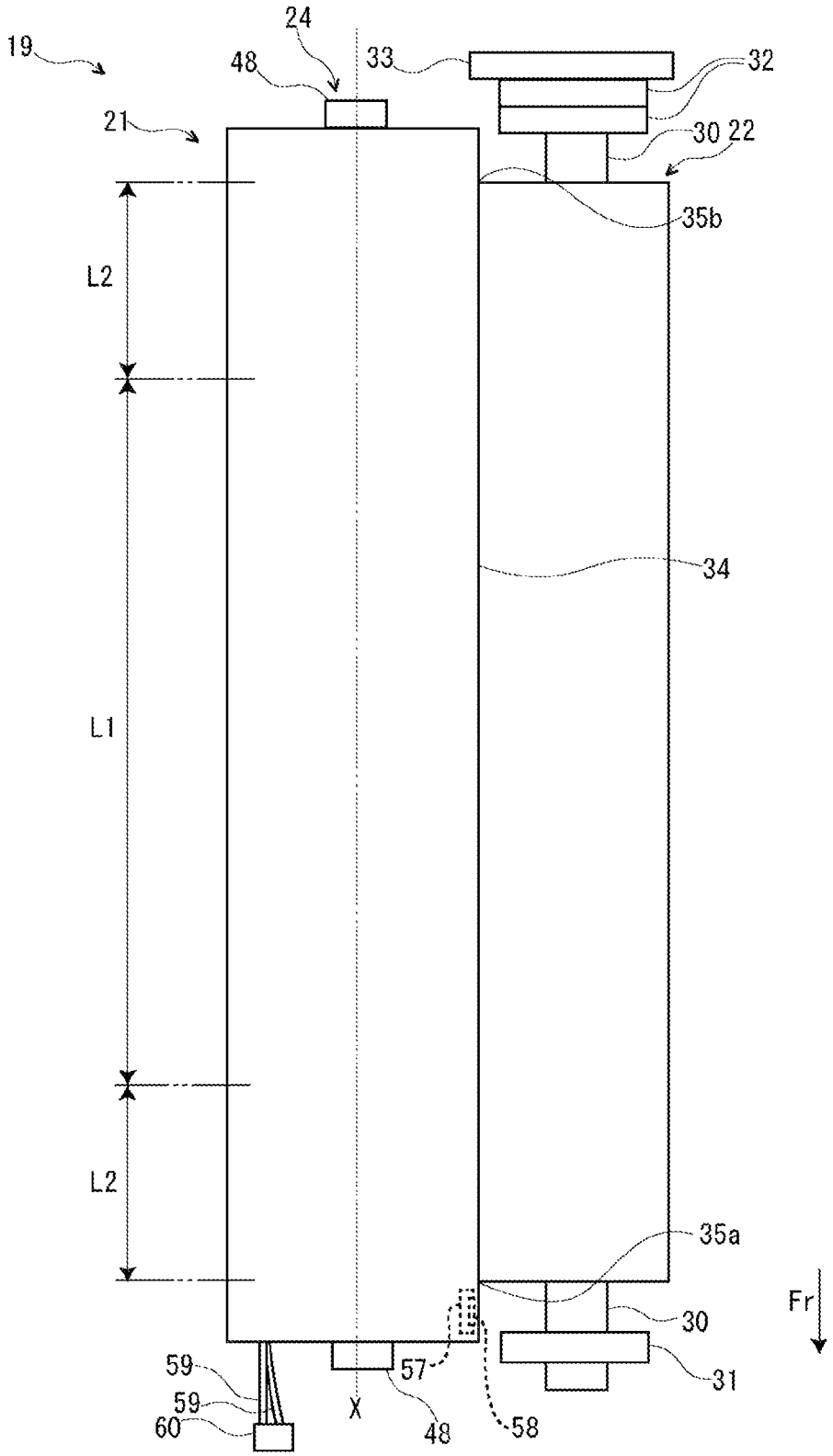
FIG. 4 is a plan view showing the fixing device in the color printer according to an embodiment of the present disclosure shown in FIG. 1.

As shown in FIG. 4, a first size sheet passage region L1 through which a paper sheet in a first size (for example, B5 paper sheet) passes is formed on a part from the front to the back of the fixing belt 21. Non-first size sheet passage regions L2 through which a paper sheet in a second size (for example, A4 paper sheet) having a larger width in the front-back direction than the paper sheet in the first size passes is formed on both front and back sides of the first size sheet passage region L1 (outside the first size sheet passage region L1).

Figure 5:
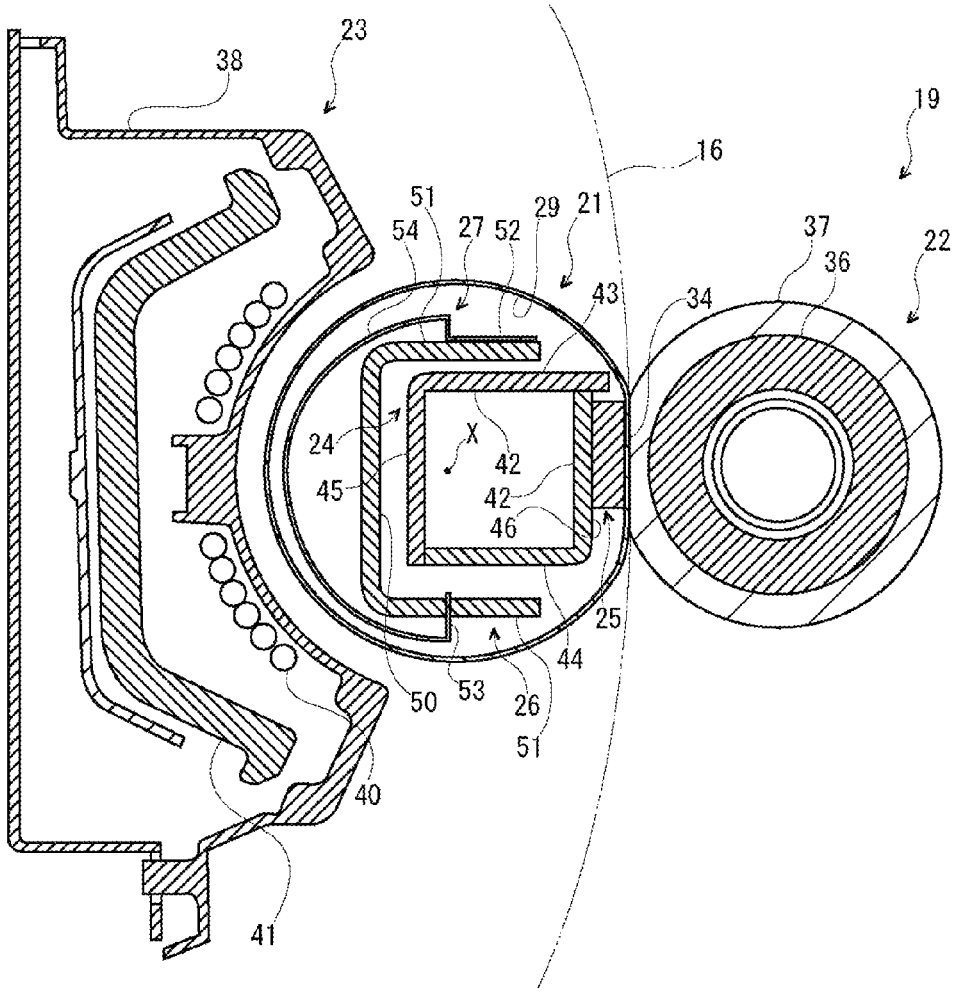
FIG. 5 is a sectional view showing the fixing device in the color printer according to an embodiment of the present disclosure shown in FIG. 1.
Figure 6:
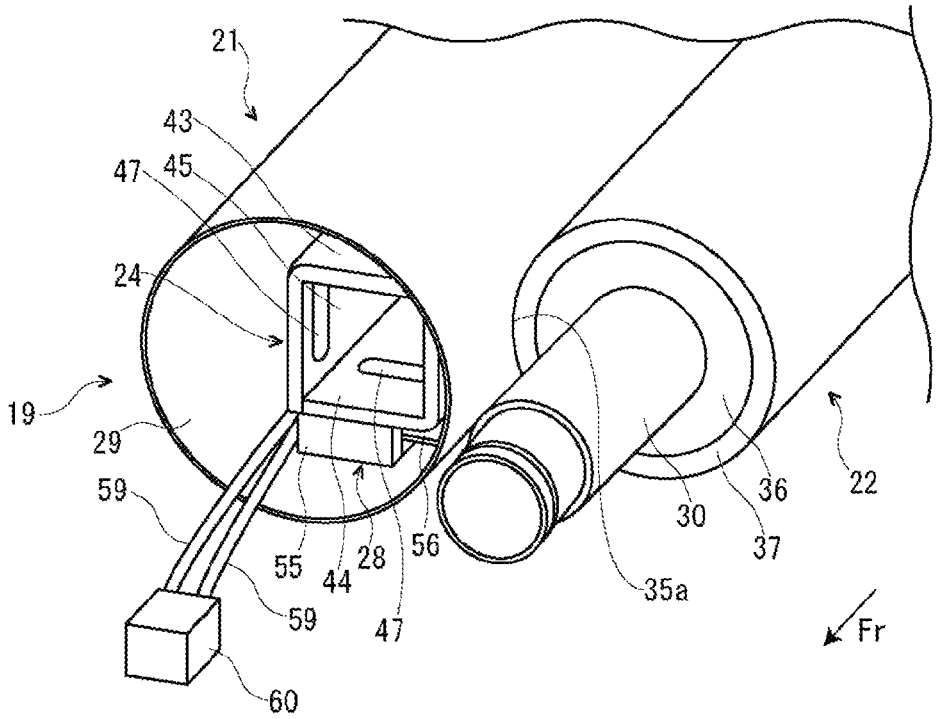
FIG. 6 is a perspective view showing a front portion of the fixing device in the color printer according to an embodiment of the present disclosure shown in FIG. 1.

Next, the pressurizing roller 22 will be described. The pressurizing roller 22 has a substantially cylindrical shape elongated in the front-back direction. As shown in FIG. 5 and other drawings, the pressurizing roller 22 is in pressed contact with the fixing belt 21 thereby to form a fixing nip 34 between the fixing belt 21 and the pressurizing roller 22 along the sheet conveyance path 16. According to the configuration, a toner image on a paper sheet is heated and pressurized to be fixed onto the paper sheet while the paper sheet passes through the fixing nip 34.

The pressurizing roller 22 includes a cylindrical core 36, an elastic layer 37 provided to surround the core 36, and a release layer (not shown) to coat the elastic layer 37, for example.

The core 36 of the pressurizing roller 22 is formed of a metal such as stainless steel or aluminum, for example. As shown in FIG. 3, the front and back end portions of the core 36 of the pressurizing roller 22 are each provided with a cylindrical mounting portion 30. A front bearing 31 is attached to the front cylindrical mounting portion 30. A pair of back bearings 32 arranged in the front-back direction are attached to the back cylindrical mounting portion 30. The front bearing 31 and the pair of back bearings 32 arranged in the front-back direction are attached to a mounting frame (not shown). Thereby, the pressurizing roller 22 is rotatable. A drive gear 33 is secured to the back cylindrical mounting portion 30 at a position behind the pair of back bearings 32 arranged in the front-back direction.

The elastic layer 37 of the pressurizing roller 22 is formed of silicone rubber or silicone sponge, for example. The release layer of the pressurizing roller 22 is formed of fluorinated resin such as PFA, for example. The elastic layer 37 and the release layer of the pressurizing roller 22 are formed so as to have a length in the front-back direction shorter than the length in the front-back direction of the fixing belt 21. Thus, edges of the pressurizing roller 22 abut the outer circumferential surface of the fixing belt 21 at both front and back end portions 35*a* and 35*b* of the fixing nip 34 (see FIGS. 4 and 6).

Next, the IH fixing unit 23 will be described. As shown in FIG. 5, the IH fixing unit 23 includes a case member 38, an IH coil 40, and an arch core 41. The IH coil 40 is contained in the case member 38 as a heat source and provided in the shape of a circular arc along the outer circumference of the fixing belt 21. It is therefore possible to increase the heating rate and the heating efficiency compared to the case where a halogen heater or the like is used as a heat source. The arch core 41 is contained in the case member 38 and provided along the outer circumference of the IH coil 40. The IH fixing unit 23 is not shown in the drawings other than FIGS. 2 and 5.

Figure 7:
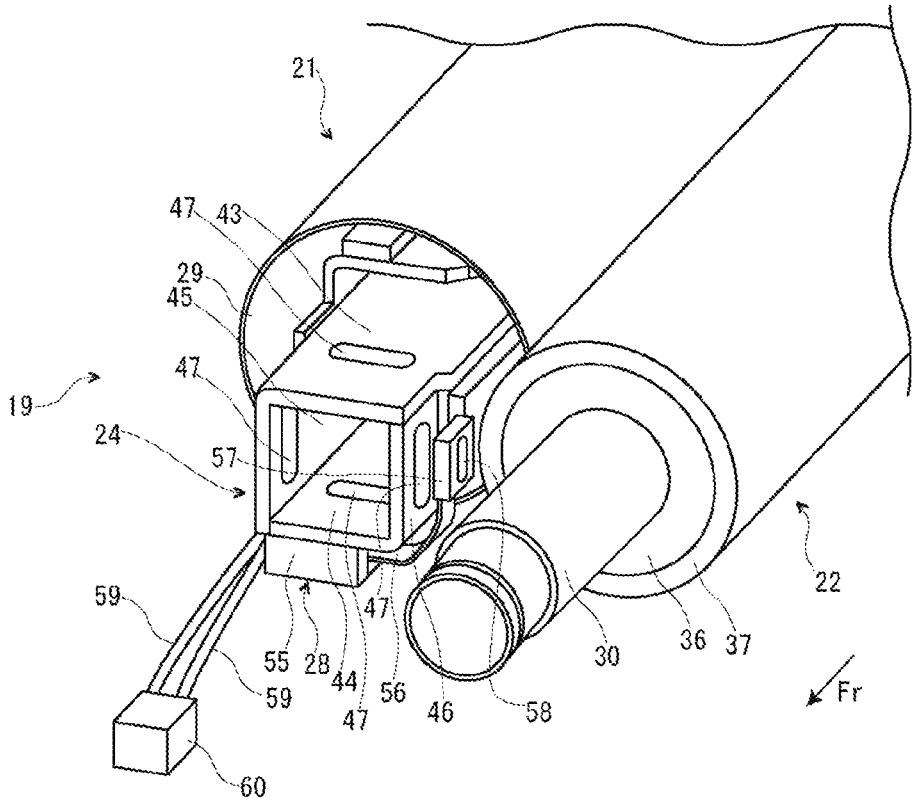
FIG. 7 is a perspective view showing the front portion of the fixing device in the color printer according to an embodiment of the present disclosure shown in FIG. 1 with a front end portion of the fixing belt cut away.

Next, the supporting member 24 will be described. The supporting member 24 is formed by combining a pair of sheet metal members 42 each having a substantially L-shaped cross section, and has a shape of a quadrangular tube elongated in the front-back direction. As shown in FIG. 7, front end portions of the walls of the supporting member 24 (an upper wall 43, a lower wall 44, a left wall 45, and a right wall 46) are each provided with an elongated through hole 47. A front end portion and a back end portion of the supporting member 24 are provided with secured pieces 48 (see FIGS. 3 and 4). Each secured piece 48 is secured to the fixing frame (not shown). The secured pieces 48 are not shown in FIG. 2.

Next, the pushing pad 25 will be described. As shown in FIG. 2, the pushing pad 25 has a vertically long substantially rectangular shape in the front view. The pushing pad 25 has a shape elongated in the front-back direction. The pushing pad 25 is secured to the right wall 46 of the supporting member 24. The pushing pad 25 is in contact with an inner circumferential surface 29 of the fixing belt 21 and pushes the fixing belt 21 toward the pressurizing roller 22 (rightward in the present embodiment). According to the configuration, the fixing belt 21 slides on the pushing pad 25 as the fixing belt 21 rotates. That is, the fixing device 19 of the present embodiment is of the "slide belt method". The pushing pad 25 is in contact only with a right-sided portion (a portion on the side of the fixing nip 34) of the inner circumferential surface 29 of the fixing belt 21. Accordingly, a central region of the fixing belt 21 in the rotation axis X direction is not tensioned in the circumferential direction (see FIG. 5). It is therefore possible to reduce the heat capacity of the members in contact with the fixing belt 21 and perform more focused heating on the fixing belt 21 compared to the case where the fixing belt 21 is provided around a roller. As a result, the reduction of the warm-up period and the energy saving can be achieved.

Next, the magnetic shielding plate 26 will be described. The magnetic shielding plate 26 is secured to the supporting member 24. The magnetic shielding plate 26 is formed of a nonmagnetic high conductivity material such as oxygen-free copper, for example. As shown in FIG. 5, the magnetic shielding plate 26 includes a side plate 50 to cover the left side of the supporting member 24, and top and bottom plates 51 formed by bending rightward upper and lower ends of the side plate 50. The magnetic shielding plate 26 has a substantially C-shaped cross section. The magnetic shielding plate 26 prevents the magnetism from the IH coil 40 from going through the supporting member 24.

Next, the guide plate 27 will be described. The guide plate 27 is secured to the magnetic shielding plate 26. The guide plate 27 is formed of a magnetic material, for example. The guide plate 27 includes an upper attachment portion 52 attached to the top plate 51 of the magnetic shielding plate 26, a lower attachment portion 53 attached to the bottom plate 51 of the magnetic shielding plate 26, and a curved portion 54 curved leftward into a circular arc shape and connecting the upper attachment portion 52 and the lower attachment portion 53. The curved portion 54 is disposed along a left-sided portion of the inner circumferential surface 29 of the fixing belt 21 and guides (stretches) the fixing belt 21 from inside.

Next, the temperature sensing device 28 will be described. As shown in FIG. 2, the temperature sensing device 28 includes a base portion 55, a flat spring 56, a sponge 57, and a thermistor 58. The base portion 55 is secured to a lower surface of the lower wall 44 of the supporting member 24. The flat spring 56 is attached to a right-sided portion of the base portion 55 at one end portion and curved upward at the other end portion. The flat spring 56 is provided as a pressing member. The sponge 57 is attached to the other end portion of the flat spring 56 as an elastic member. The thermistor 58 is attached to the sponge 57 as a sensing element.

The inner side surface (left-sided surface in the present embodiment) of the sponge 57 is attached to the other end portion of the flat spring 56. The thermistor 58 is attached to the outer side surface (right-sided surface in the present embodiment) of the sponge 57. That is, the sponge 57 intervenes between the flat spring 56 and the thermistor 58. Except the region to which the thermistor 58 is attached, the right-sided surface of the sponge 57 is in contact with the inner circumferential surface 29 of the fixing belt 21 in a neighboring region of the front end portion 35*a* of the fixing nip 34. Specifically, the sponge 57 is located slightly in advance of the front end portion 35*a* of the fixing nip 34 (located outward in the rotation axis X direction) (see FIG. 4). The sponge 57 is pressed against the inner circumferential surface 29 of the fixing belt 21 by the flat spring 56 at a constant pressure. Thus, the thermistor 58 can be pressed against the inner circumferential surface 29 of the fixing belt 21 by a simple configuration with the flat spring 56.

The thermistor 58 is in contact with the inner circumferential surface 29 of the fixing belt 21 in the neighboring region of the front end portion 35*a* of the fixing nip 34. Specifically, the thermistor 58 is located slightly in advance of the front end portion 35*a* of the fixing nip 34 (located outward in the rotation axis X direction) (see FIG. 4). Arranged as described above, the thermistor 58 is in the vicinity of the non-first size sheet passage region L2 of the fixing belt 21. The thermistor 58 is pressed against the inner circumferential surface 29 of the fixing belt 21 by the flat spring 56 at a constant pressure. The thermistor 58 is connected to a connector 60 via a pair of wires 59.

Figure 8:
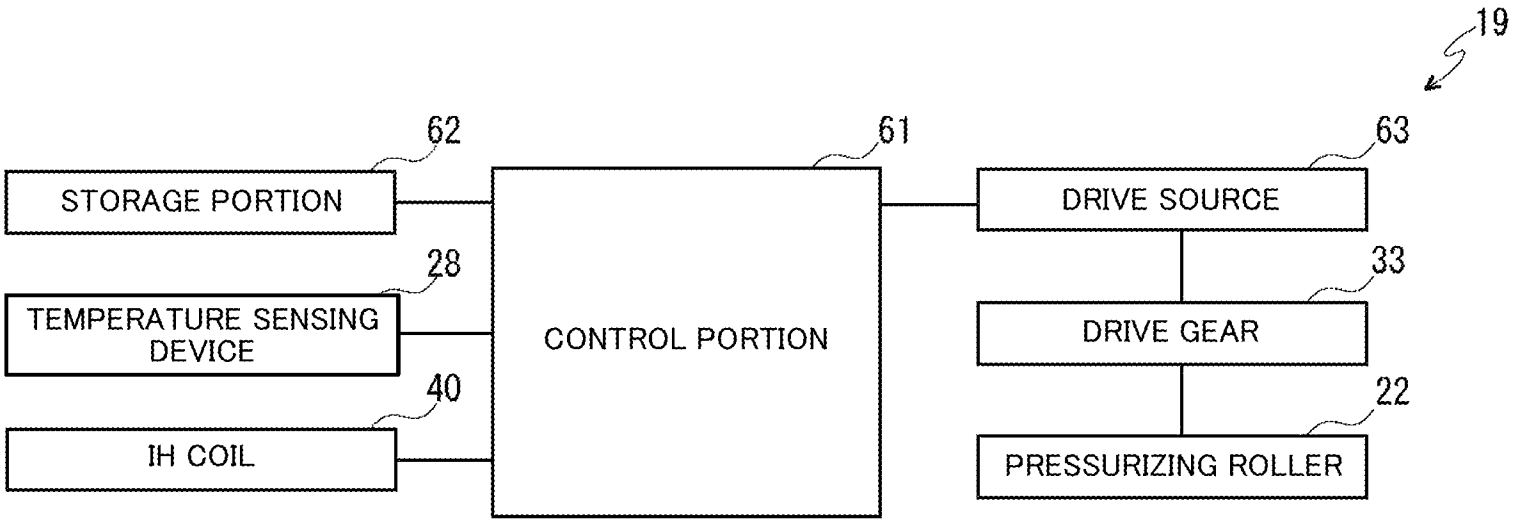
FIG. 8 is a block diagram showing a configuration of the fixing device in the color printer according to an embodiment of the present disclosure shown in FIG. 1.

Next, a control system of the fixing device 19 will be described with reference to FIG. 8.

The fixing device 19 is provided with a control portion 61 (CPU). The control portion 61 is connected to a storage portion 62 including a memory such as a ROM or a RAM. The control portion 61 is configured to control each component of the color printer 1 based on a control program and control data stored in the storage portion 62. The storage portion 62 stores therein a threshold $T_{th}$ of the temperature of the fixing belt 21 to be detected by the thermistor 58 of the temperature sensing device 28.

The control portion 61 is connected to the temperature sensing device 28. The temperature sensing device 28 is configured to output a detection result to the control portion 61 when the thermistor 58 of the temperature sensing device 28 detects the temperature of the fixing belt 21.

The control portion 61 is connected to the IH coil 40. When a high frequency current flows through the IH coil 40 based on a drive command signal from the control portion 61, a high frequency magnetic field is generated around the IH coil 40 and the fixing belt 21 is heated by the high frequency magnetic field. That is, the control portion 61 is configured to control the heating of the fixing belt 21 by the IH coil 40.

The control portion 61 is connected to a drive source 63. The drive source 63 is connected to the pressurizing roller 22 via the drive gear 33. Rotation is transmitted from the drive source 63 to the pressurizing roller 22 via the drive gear 33, thereby rotating the pressurizing roller 22.

When a print signal has been transmitted to the control portion 61 in the color printer 1 configured as described above, a high frequency current flows through the IH coil 40 based on a drive command signal from the control portion 61. The high frequency current generates a high frequency magnetic field around the IH coil 40, and the fixing belt 21 is heated by the high frequency magnetic field. Meanwhile, when the print signal has been transmitted to the control portion 61 as described above, the drive source 63 causes the pressurizing roller 22 to rotate based on the drive command signal from the control portion 61. With the rotation of the pressurizing roller 22, the fixing belt 21 in pressed contact with the pressurizing roller 22 rotates in a direction opposite to the rotation direction of the pressurizing roller 22. Then, when a paper sheet is conveyed along the conveyance path 16, the paper sheet passes through the fixing nip 34. Thus, a toner image is fixed onto the paper sheet.

In the case where the toner image is fixed onto a paper sheet in the second size, the paper sheet is heated in the whole area of the fixing nip 34, and thus the heat is equally consumed in the first size sheet passage region L1 and in the non-first size sheet passage regions L2 of the fixing belt 21. Thus, the temperature of the non-first size sheet passage regions L2 of the fixing belt 21 will not rise to be excessively higher than the temperature of the first size sheet passage region L1. Accordingly, the temperature of the fixing belt 21 detected by the thermistor 58 disposed in the vicinity of the non-first size sheet passage region L2 of the fixing belt 21 will not exceed the threshold $T_{th}$ stored in the storage portion 62.

In the case where the toner image is continuously fixed onto paper sheets in the first size, on the other hand, the heat is consumed in the first size sheet passage region L1 of the fixing belt 21 with the heating of the paper sheets, but no heat is consumed in the non-first size sheet passage regions L2 of the fixing belt 21. Thus, the temperature of the non-first size sheet passage regions L2 of the fixing belt 21 will rise to be excessively higher than the temperature of the first size sheet passage region L1. Accordingly, the temperature of the fixing belt 21 detected by the thermistor 58 disposed in the vicinity of the non-first size sheet passage region L2 of the fixing belt 21 will exceed the threshold $T_{th}$ stored in the storage portion 62. In response, the control portion 61 stops or lessens the heating by the IH coil 40 on the non-first size sheet passage regions L2 of the fixing belt 21. For example, the control portion 61 changes the magnetic flux density distribution of the IH coil 40 so that the heating of the non-first size sheet passage regions L2 of the fixing belt 21 is stopped or lessened.

In the present embodiment, as described above, the thermistor 58 is in contact with the inner circumferential surface 29 of the fixing belt 21 in the neighboring region of the front end portion 35*a* of the fixing nip 34, and the flat spring 56 is pressing the thermistor 58 against the inner circumferential surface 29 of the fixing belt 21. With such a configuration, the stress applied on the fixing belt 21 in the neighboring region of the front end portion 35*a* of the fixing nip 34 can be distributed, and local deformation and damage of the fixing belt 21 can be prevented.

In addition, since the thermistor 58 is in contact with the inner circumferential surface 29 of the fixing belt 21 in the neighboring region of the front end portion 35*a* of the fixing nip 34, the thermistor 58 is located in the vicinity of the non-first size sheet passage region L2 of the fixing belt 21. It is therefore possible to have a grasp of the temperature of the non-first size sheet passage regions L2 of the fixing belt 21 through the temperature detected by the thermistor 58. Furthermore, since the thermistor 58 is in contact with the inner circumferential surface 29 of the fixing belt 21, the space within the fixing belt 21 can be effectively used.

Incidentally, the above-mentioned special shape of the pushing member may increase the production cost of the pushing member, leading to increase in cost of the fixing device. Likewise, the above-mentioned configuration in which the temperature of the non-first size sheet passage regions is prevented from rising to be excessively higher than the temperature of the first size sheet passage region with a thermally conductive member may also increase the cost of materials due to the use of the thermally conductive member, leading to increase in cost of the fixing device. With the configuration in which the thermistor 58 that detects the temperature of the fixing belt 21 is used to prevent local deformation and damage of the fixing belt 21, it is not necessary to add a member for exclusive use of the prevention of local deformation and damage of the fixing belt 21. Thus, increase in cost can be prevented.

According to a configuration without the temperature sensing device 28, it is impossible to perform the feedback control on the IH coil 40, and it is difficult to have a grasp of the temperature of the non-first size sheet passage regions L2 of the fixing belt 21. In contrast, the present embodiment is configured to stop or lessen the heating by the IH coil 40 on the non-first size sheet passage regions L2 of the fixing belt 21 when the temperature of the fixing belt 21 detected by the thermistor 58 exceeds the threshold $T_{th}$ stored in the storage portion 62. With such a configuration, the temperature of the non-first size sheet passage regions L2 of the fixing belt 21 can be prevented from rising to be excessively higher than the temperature of the first size sheet passage region L1 by the feedback control, and thus uniform temperature distribution in the fixing belt 21 can be achieved.

That is, the color printer 1 allows grasp of the temperature of the non-first size sheet passage regions L2 of the fixing belt 21 while preventing increase in cost. Besides, the color printer 1 allows distribution of the stress applied on the fixing belt 21 in the neighboring region of the end portion of the fixing nip 34, preventing local deformation and damage of the fixing belt 21.

In addition, the sponge 57 intervenes between the thermistor 58 and the flat spring 56. Accordingly, the pressing force of the flat spring 56 to the thermistor 58 against the inner circumferential surface 29 of the fixing belt 21 can be lessened, and damage of the thermistor 58 and the fixing belt 21 can be avoided. Furthermore, the sponge 57 is in contact with the inner circumferential surface 29 of the fixing belt 21 in the neighboring region of the front end portion 35*a* of the fixing nip 34. Accordingly, the stress applied on the fixing belt 21 in the neighboring region of the front end portion 35*a* of the fixing nip 34 can be distributed more efficiently, and local deformation and damage of the fixing belt 21 can be prevented more reliably.

The fixing belt 21 is rotatable around the rotation axis X, and the thermistor 58 is located in advance of the front end portion 35*a* of the fixing nip 34 (located outward in the rotation axis X direction). Thus, the thermistor 58 can be disposed at a position where it does not interfere with the pushing pad 25 disposed within the fixing belt 21.

In the present embodiment, the case where the thermistor 58 is located outward in the rotation axis X direction with respect to the front end portion 35*a* of the fixing nip 34 has been described. In another embodiment, however, a sensing element such as the thermistor 58 may be disposed inward in the rotation axis X direction with respect to the end portion of the fixing nip 34. That is, the neighboring region of the end portion of the fixing nip 34 includes both regions outward and inward in the rotation axis X direction with respect to the end portion of the fixing nip 34. In order to have a grasp of the temperature of the non-first size sheet passage regions L2 of the fixing belt 21 through the temperature detected by a sensing element such as the thermistor 58, however, the thermistor 58 is desirably located outward in the rotation axis X direction at least with respect to the first size sheet passage region L1 of the fixing belt 21.

In the present embodiment, as described above, the case where the thermistor 58 is disposed in the neighboring region of the front end portion 35*a*, which is one end portion of the fixing nip 34, has been described. In another embodiment, however, sensing elements such as the thermistor 58 may be disposed in the neighboring regions of both the end portions (for example, the front end portion 35*a* and the back end portion 35*b*) of the fixing nip 34, respectively.

In the present embodiment, the case where the drive source 63 is connected to the pressurizing roller 22 has been described. In another embodiment, however, the drive source 63 may be connected to the fixing belt 21.

In the present embodiment, the case where the flat spring 56 is used as the pressing member has been described. In another embodiment, however, a coil spring or the like may be used as the pressing member.

In the present embodiment, the case where the magnetic flux density distribution of the IH coil 40 is changed in order to stop or lessen the heating on the non-first size sheet passage regions L2 of the fixing belt 21 has been described. In another embodiment, however, a heater such as a halogen heater may be used as a heat source, and a first heater that can heat both the first size sheet passage region L1 and the non-first size sheet passage regions L2 of the fixing belt 21, and a second heater that can exclusively heat the first size sheet passage region L1 of the fixing belt 21 may be contained in the fixing belt 21, and the heating on the non-first size sheet passage regions L2 of the fixing belt 21 may be stopped or lessened by turning off the first heater and turning on the second heater when the temperature of the fixing belt 21 detected by a sensing element such as the thermistor 58 exceeds a predetermined threshold. In still another embodiment, the non-first size sheet passage regions L2 may be cooled by applying cooling air from a fan (not shown) to the non-first size sheet passage regions L2 of the fixing belt 21 when the temperature of the fixing belt 21 detected by a sensing element such as the thermistor 58 exceeds a predetermined threshold.

In the present embodiment, the case where the backing layer of the fixing belt 21 is formed of a metal has been described. In another embodiment, however, the backing layer of the fixing belt 21 may be formed of a resin such as polyimide.

In the present embodiment, the case where the IH coil 40 is used as the heat source has been described. In another embodiment, however, a heater such as a halogen heater or a ceramic heater may be used as the heat source.

In the present embodiment, the case where the configuration of the present disclosure is applied to the fixing device 19 of the "slide belt method" has been described. In another embodiment, however, the configuration of the present disclosure may be applied to a fixing device of a method in which the fixing belt 21 is provided around one roller or a plurality of rollers.

In the present embodiment, the case where the configuration of the present disclosure is applied to the color printer 1 has been described. In another embodiment, however, the configuration of the present disclosure may be applied to other image forming apparatuses such as monochrome printers, copying machines, facsimiles, and multifunction peripherals.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A fixing device comprising:

a rotatable fixing belt provided so as to be rotatable around a predetermined rotation axis;

a rotatable pressurizing member being in pressed contact with the fixing belt to form a fixing nip between the pressurizing member and the fixing belt;

a heat source configured to heat the fixing belt; and a temperature sensing device configured to detect a temperature of the fixing belt, the temperature sensing device comprising:

a sensing element being in contact with an inner circumferential surface of the fixing belt in a neighboring region of an end portion of the fixing nip;

a flat spring configured to press the sensing element against the inner circumferential surface of the fixing belt; and an elastic member intervening between the sensing element and the flat spring, wherein the sensing element and the elastic member are in contact with the inner circumferential surface of the fixing belt in the neighboring region of the end portion of the fixing nip in a direction parallel to the rotation axis.

2. The fixing device according to claim 1, wherein the fixing belt has a first size sheet passage region through which a paper sheet of a first size passes, and a non-first size sheet passage region which is outside the first size sheet passage region and through which a paper sheet of a second size having a larger width than the paper sheet of the first size passes, and the heat source stops or lessens heating on the non-first size sheet passage region of the fixing belt when the temperature of the fixing belt detected by the sensing element exceeds a predetermined threshold.

3. The fixing device according to claim 1, further comprising a pushing member being in contact with the inner circumferential surface of the fixing belt and being configured to push the fixing belt toward the pressurizing member, wherein the fixing belt slides on the pushing member as the fixing belt rotates.

4. The fixing device according to claim 1, wherein the heat source has an IH coil.

5. The fixing device according to claim 1, wherein a surface of the elastic member disposed on a side of the inner circumferential surface of the fixing belt is, except for a portion on which the sensing element is attached, made of sponge so as to be in contact with the inner circumferential surface of the fixing belt.

6. The fixing device according to claim 1, wherein when the fixing device is viewed from a direction of the rotation axis, the sensing element and the elastic member are in contact with the fixing nip.

7. An image forming apparatus comprising a fixing device, the fixing device comprising:

a rotatable fixing belt provided so as to be rotatable around a predetermined rotation axis;

a rotatable pressurizing member being in pressed contact with the fixing belt to form a fixing nip between the pressurizing member and the fixing belt;

a heat source configured to heat the fixing belt; and a temperature sensing device configured to detect a temperature of the fixing belt, the temperature sensing device comprising:

a sensing element being in contact with an inner circumferential surface of the fixing belt in a neighboring region of an end portion of the fixing nip;

a flat spring configured to press the sensing element against the inner circumferential surface of the fixing belt; and an elastic member intervening between the sensing element and the flat spring, wherein the sensing element and the elastic member are in contact with the inner circumferential surface of the fixing belt in the neighboring region of the end portion of the fixing nip in a direction parallel to the rotation axis.

8. The image forming apparatus according to claim 7, wherein the fixing belt has a first size sheet passage region through which a paper sheet of a first size passes and a non-first size sheet passage region which is outside the first size sheet passage region and through which a paper sheet of a second size having a larger width than the paper sheet of the first size passes, and the heat source stops or lessens heating on the non-first size sheet passage region of the fixing belt when the temperature of the fixing belt detected by the sensing element exceeds a predetermined threshold.

9. The image forming apparatus according to claim 7, further comprising a pushing member being in contact with the inner circumferential surface of the fixing belt and being configured to push the fixing belt toward the pressurizing member, wherein the fixing belt slides on the pushing member as the fixing belt rotates.

10. The image forming apparatus according to claim 7, wherein the heat source has an IH coil.

* * * * *